US006024641A

United States Patent [19]

Sarno

[11] Patent Number: 6,024,641

[45] Date of Patent: Feb. 15, 2000

[54] METHOD, APPARATUS AND SYSTEM FOR LOTTERY GAMING

[76] Inventor: Robert A. Sarno, 2064 N. New Hampshire Ave., Los Angeles, Calif. 90027

[21] Appl. No.: 09/192,875

[22] Filed: Nov. 16, 1998

Related U.S. Application Data

[60] Provisional application No. 60/066,205, Nov. 19, 1997.

[51] Int. Cl.[7] ..... A63B 71/00

[52] U.S. Cl. ..... 463/17; 273/138.2; 273/139; 463/42

[58] Field of Search ..... 463/16–19, 25, 463/29–30, 36, 40–42; 273/139, 138.2, 269, 161; 364/410.1, 412.1; 379/93.13; 358/400

[56] References Cited

U.S. PATENT DOCUMENTS

| | | | |
|---|---|---|---|
| 4,087,092 | 5/1978 | Krause | 273/138 |
| 4,592,546 | 6/1986 | Fascenda et al. | 463/40 |
| 4,842,278 | 6/1989 | Markowicz | 463/26 |
| 5,269,521 | 12/1993 | Rossides | 463/16 |
| 5,283,734 | 2/1994 | Von Kohorn | 463/40 |
| 5,779,549 | 7/1998 | Walker et al. | 463/25 |

*Primary Examiner*—Valencia Martin-Wallace
*Assistant Examiner*—Mark A Sager
*Attorney, Agent, or Firm*—Gregory A. Piccionelli; Anna M. Vradenburgh

[57] ABSTRACT

Embodiments of the instant invention are directed to a method, apparatus and system for lottery gaming, wherein a simple, objective, verifiable and reliable method of selecting the winning lottery numbers is provided. In preferred embodiments, a user accesses the game via a wide area network or by some other remote means and inputs required information, including payment information and the user's selections for the game. Prior to any user participating in the game, the game provider selects elements that comprise a winning combination. Preferably, the elements that comprise the winning combination are objective and verifiable elements, such as, for example, a portion of the closing stock market price on a given day for a specified set of markets. As such, the elements comprising the winning combinations are objective and can be verified by all of the users. The definition of the winning combination can be redefined for each new game, or as it is generated from a indicia providing source, can remain the same for all games or a set number of games.

21 Claims, 9 Drawing Sheets

Winning Combination: last two digits
of identified closing market (98,67,40,09,79,65)

| | |
|---|---|
| Frankfurt DAX | 37<u>98</u>.51 |
| Paris CAC 40 | 28<u>67</u>.34 |
| London FTSE | 46<u>40</u>.97 |
| New York NYSE | 77<u>09</u>.35 |
| Tokyo Nikkei 225 | 14,6<u>79</u>.64 |
| Hong Kong Hang Seng | 8,0<u>65</u>.02 |

FIG. 8

METHOD, APPARATUS AND SYSTEM FOR LOTTERY GAMING

This application claims benefit of provisional Application 60/066,205, Nov. 19, 1997.

FIELD OF THE INVENTION

The instant invention is directed to a method, apparatus and system for playing lottery, lottery-type and other games which provides an objective game result authentication; in particular, a lottery-type gaming method, apparatus and system played by the end users on one or more wide area computer networks or other computer network means, or by the use of a telephone, facsimile, personal digital assistant, pulse code system, web TV, or any other device or method that communicates alpha numeric data with a server, wherein the results are objectively verifiable and not, directly controlled by the game provider.

BACKGROUND OF THE INVENTION

Vast majorities of people are intrigued by games of chance. Indeed, cities, such as Las Vegas and Atlantic City have established the economic success of their city primarily on the gaming or lottery-type entertainment. The intrigue of this entertainment is based, in part, on the thrill of the risk involved and the opportunity for enormous returns based upon the risk taken. Although most people do not gain enormous returns on the investments, or the wagers made, people continue to play because of the very real opportunity for such returns.

As some gaming is prohibited in certain states, localized gaming has been established in particular places, such as, for example, foreign countries, states which have legalized gaming and in territories where gaming is legal, such as, on Indian reservations. A problem with some current gaming opportunities is that their locations are not convenient for most people. Thus, many people who cannot afford to travel to one of these locations cannot participate in the gaming experience.

To alleviate some of the inconvenience, many states which do not allow gaming have established local lotteries. Indeed, many countries other than the United States also offer lotteries. These lotteries, while convenient for those local to the lottery, are inconvenient for those who do not live within the vicinity of the location offering the lottery.

Since the advent of wide area networks, such as, for example, the Internet or the World Wide Web ("WWW"), global gaming has become of interest. Indeed, casino-type gaming enterprises have developed over wide area networks and offer a wide variety of gaming activities. Gaming on the Internet provides for the potential of returns, or jackpots, far greater than that generated at the local levels due to the international access. Thus, on-line gaming can provide for more exciting games as the game allows world wide involvement.

Although the lotteries on wide area networks provide convenience, relative ease of access and the potential for enormous winnings, one problem with casino-type gaming enterprises offered via computer networks, or in some other remote manner, is that it is virtually impossible to assure players that the virtual casino game is fair and has not been "virtually" manipulated or fixed in some manner. Indeed, as many on-line casino-type gaming enterprises are not local, it is difficult, and in some instances, impossible, to ascertain an assessment of the legitimacy of the entity or person offering the gaming. Current gaming on networks, such as the Internet, require that the player trust that the online gaming enterprise honestly reports the result of the games as there are no objective indicia that can be independently reviewed by the players to determine the results of the games.

As such, a need in the industry exists to provide a casino-type or lottery entertainment on wide area networks that provide for an objective indicia of the results of the game such that the individual players can ascertain the results of the game and be confident in their authenticity. Further, a need exists for a gaming method that provides for a verifiable method of selecting the winning results of the game.

BRIEF DESCRIPTION OF THE DRAWINGS

The detailed description of embodiments of the invention will be made with reference to the accompanying drawings, wherein like numerals designate corresponding parts in the figures.

FIG. 8 is a preferred embodiment of a predefined combination designating the composition of the winning numbers.

SUMMARY OF THE DISCLOSURE

Figure 1:
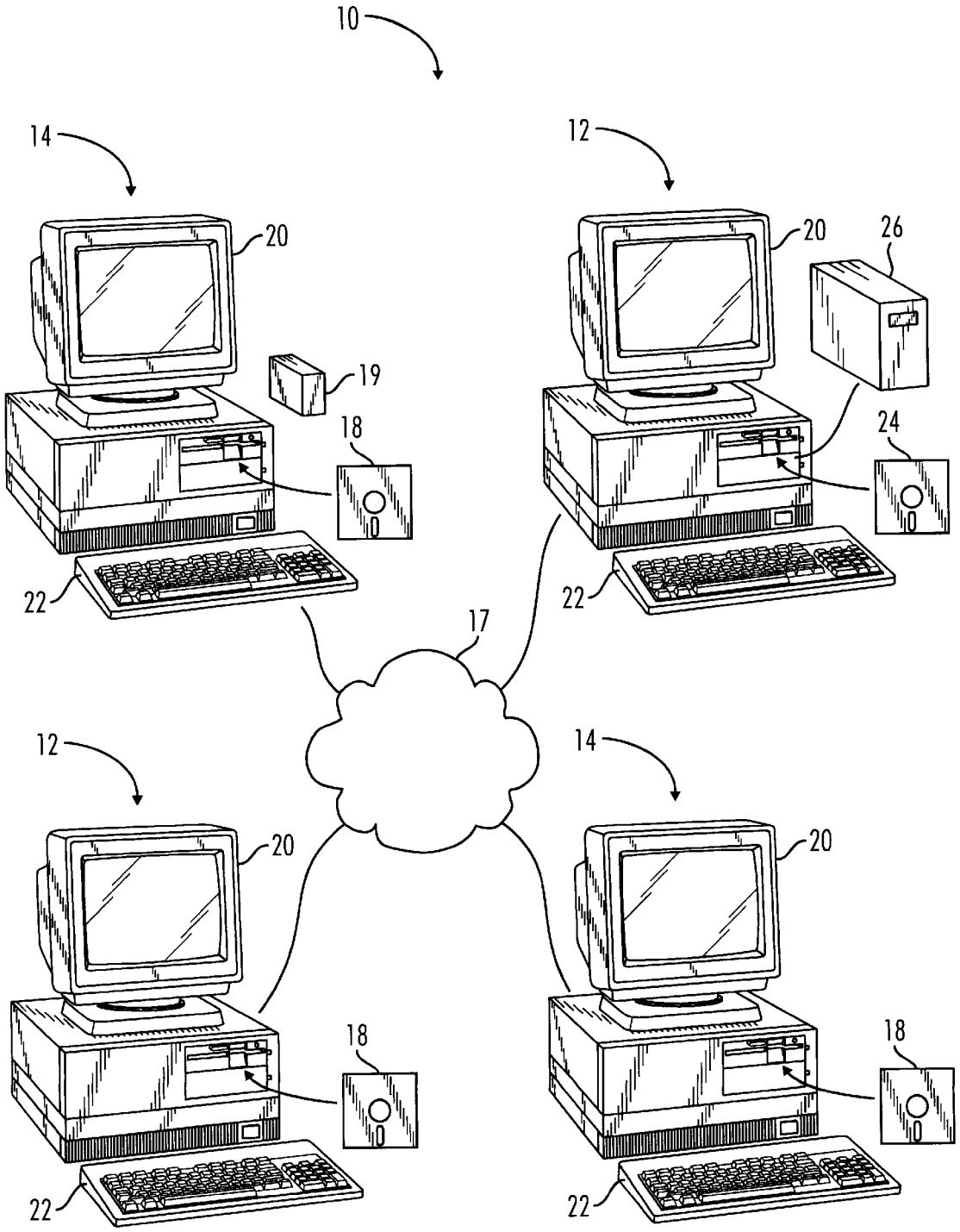
FIG. 1 is a network system environment in accordance with a preferred embodiment of the instant invention.

Embodiments of the instant invention provide objective game result authentication that each individual player can ascertain and verify on their own. Further, unlike current methods for remote play of lottery or lottery-type games, the instant invention provides a simple, objective, verifiable and reliable method of selecting the winning lottery numbers.

In preferred embodiments, a user accesses the game via a wide area network or by some other remote means. The user is requested to input information regarding identification of the user and payment means. Once the user has decided to actually participate in the game and has provided the requested information, the user accesses a gaming page which accepts either random indicia provided or generated by the computer at the user's request, or the user's selections of numbers and/or characters for the given game. Once the user has inputted the selection of numbers and/or characters, the user is sent to the confirmation page which confirm the user's winning numbers and/or characters. The user is then sent an e-mail confirmation of the user's numbers and/or character and, in some preferred embodiments, an identification number. If the user plays via a kiosk, the user receives a printed ticket with the selection numbers and/or characters, and the identification number. The user then need only wait for the time designated for the winning combination to be chosen.

Prior to the users participating in the game, the game provider selects elements that comprise a winning combination. The selected elements are explained on the game pages such that the users are aware of the identification of the sources which will ultimately provide the numbers and/or characters for the winning combination. Preferably, the elements that comprise the winning combination are objective and verifiable elements, such as, for example, a portion of the closing stock market price on a given day for a specified set of markets. As such, the elements comprising the winning combinations are objective and can be verified by all of the users. The definition of the winning combination can be redefined for each new game, or as it is generated from a indicia providing source, can remain the same for all games or a set number of games.

A feature of preferred embodiments of the instant invention is that the composition of the winning combination comprises aspects of a published source which generates indicia numbers and/or characters. An advantage of this feature is that the users can be confident that the winning combination is not controlled or "rigged" by the game provider. A further advantage is that the winning combination is instantaneously verifiable by every user or game participant as the elements comprising the winning combination are published. A still further advantage is that the composition of the winning combination can be redefined for any game.

Another feature of preferred embodiments is that the game is available to a global market. An advantage of this feature is that the potential returns can be enormous.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

DETAILED DESCRIPTION OF PREFERRED EMBODIMENTS

Preferred embodiments of the instant invention operate on a network, such as, for example, the WWW, or another type of remote access system, such as, a kiosk, telephone, facsimile, personal digital assistant, pulse code system, web TV, or any other device or method the communicates alpha numeric data with a server.

Hardware Environment

Preferred embodiments of the instant invention operate in accordance with a plurality of networked computers, such as, for example, a user computer and a server computer which are coupled together on a communications network, such as, for example, the Internet or a wide area network. FIG. 1 depicts a network system 10 that operates in accordance with preferred embodiments of the invention. In preferred embodiments, the network system 10 includes a server computer 12, or a provider computer, and a client, or user computer 14, wherein the server computer 12 and the user computer 14 is in electronic communication with each other via a communication link 17.

In some preferred embodiments, the network system 10 includes a plurality of either the server 12, the user computer 14, or any combination thereof. The server 12 contains gaming data and other relevant data that is accessible by the user computer 14 or clients. Preferably, the network 10 includes one or more (and preferably a plurality of) servers 12 that are operatively connected to the communication link 17. Two such servers 12 are shown in FIG. 1. It will be understood that network systems in accordance with further embodiments may include more than two servers 12.

The provider computer 12, or server, may comprise any suitable network device capable of providing content (data representing text, hypertext, photographs, graphics video and/or audio) for communication over the network. In preferred embodiments, the provider computer 12 comprises a programmable processor capable of operating in accordance with programs stored on one or more computer readable media 24 (for example, but not limited to, floppy disks, hard disks, random access memory RAM, CD-ROM), to provide content for communication to a user computer 14. The provider computer 12 may comprise, for example, but not limited to, a personal computer, a mainframe computer, network computer, portable computer, personal digital assistant (such as, a 3Com Palm Pilot), or the like. The provider computer 12 may include one or more internal data storage devices (not shown) for storing content for communication to a user computer 14. Alternatively, or in addition, the provider computer 12 may be coupled to an external data storage device, computer or other means, generally represented at 26, from which the provider computer 12 may obtain content for communication to a user computer 14. In one embodiment, the external device 26 may comprise a further network device coupled in the network 17. The provider computer 12 is controlled by suitable software to provide the requested content to the requesting user computer 14, provided that various criteria are met.

In a preferred wide area network environment, such as, the Internet environment, the provider computer 12 is controlled by suitable software to respond to a valid request for content by providing (or downloading) data in the form of one or more HTML files to the user computer 14 from which the request was made. It will be understood by those skilled in the art that this process involves communications through suitable servers, routers and other components, as is dictated by the particular network environment.

Each server 12 operates with a persistent storage means 19, for example, one or more of the fixed and/or removable data storage devices and/or data communications devices connected to the computer. The communication link 17 may include a public network, such as the Internet, a local area network, or any other suitable communications connection, hardwired, wireless, or a hybrid thereof.

The user computer 14 may comprise any suitable network device capable of communicating with other network devices in the network system. In preferred embodiments, the user computer comprises a programmable processor capable of operating in accordance with programs stored on one or more computer readable media 18 (for example, but not limited to floppy disc, hard disc, computer network, random access memory (RAM), CD Rom, or the like), a display device 20 for providing a user-perceivable display (for example, but not limited to visual displays, such as cathode ray tube CRT displays, light-emitting-diode LED or liquid-crystal-diode LCD displays, plasma displays or the like, audio displays or tactile displays), and a user input device 22 (for example, but not limited to, a keyboard, mouse, microphone, or the like). In one preferred embodiment, the user computer comprises a personal computer system having a CRT display, a keyboard and a mouse user-input device.

The user computer 14 is controlled by suitable software, including network communication and browser software to allow a user to request, receive and display information (or content) from or through a provider computer 12 on the network system 10. The user computers 14 operate in accordance with programs stored on a readable medium 18, including, but not limited to, floppy disks, hard disks, RAM and CD-ROM. The user computers 14 are any means capable of communicating with the server computers 12, including, but not limited, to personal computers, kiosks and ATM-type machines. The user computers 14 access the server computers 12 via the wide area network or through some other remote access, such as, for example, by telephone, facsimile, personal digital assistant, pulse code system, web TV, or any other device or method the communicates alpha numeric data with a server.

General Description of Preferred Embodiments

Preferred embodiments of the instant invention comprise an objective representation of the results of a game and further provide a verifiable method of selecting the winning results of the game Indeed, individual players can independently ascertain the results of the game and verify the authenticity of such results.

Figure 2:
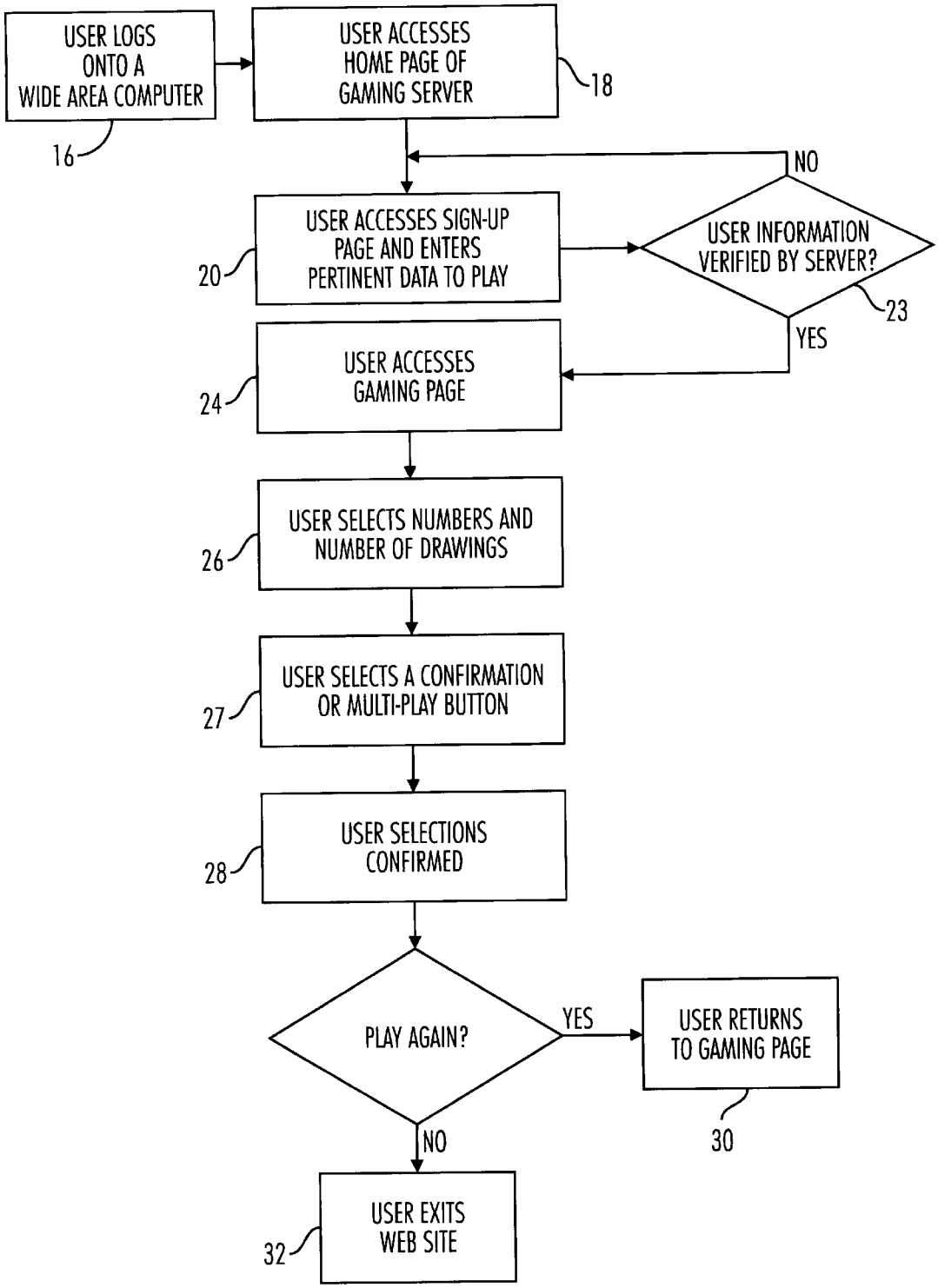
FIG. 2 depicts a block diagram of a preferred embodiment of the instant invention.

With reference to FIG. 2, players who are desirous of participating in a particular game, establish a connection on a wide area computer network 16 between a user computer 14 and a gaming server 12. In preferred embodiments, a relatively unlimited number of players can play at any given time and for any given game. Indeed, in preferred embodiments, global participation in any given game is possible.

Once a player has established a connection with the gaming server 12 (FIG. 1), the player accesses an initial or home page 18 (FIG. 2) of the gaming server 12. To participate in a game, the user must register or sign-up and can access a sign-up page via the home page. Once a user has accessed the sign-up page, the user is able to enter pertinent information 20, such as, for example, the method of payment information and information for user confirmation, such as, for example, an e-mail address. The inputted information is conveyed to the gaming server 12, which verifies the inputted information 23, such as, for example, the credit information or account information. If the inputted information is accepted, the server allows the user to access a gaming page 24 (FIG. 2) via an access button 51 (FIG. 4), such as a "play" button.

Once connected to the gaming page, the user enters selections, such as, for example, a group of numbers, alphabet characters, words, or other indicia, and further enters the number of desired drawings 26, that is, the number of games to play with these numbers, alphabet characters, words, or other indicia. The "selection" is data, such as, numbers, alphabet characters, words, or other indicia, representing the user's choices for the game.

Figure 5:
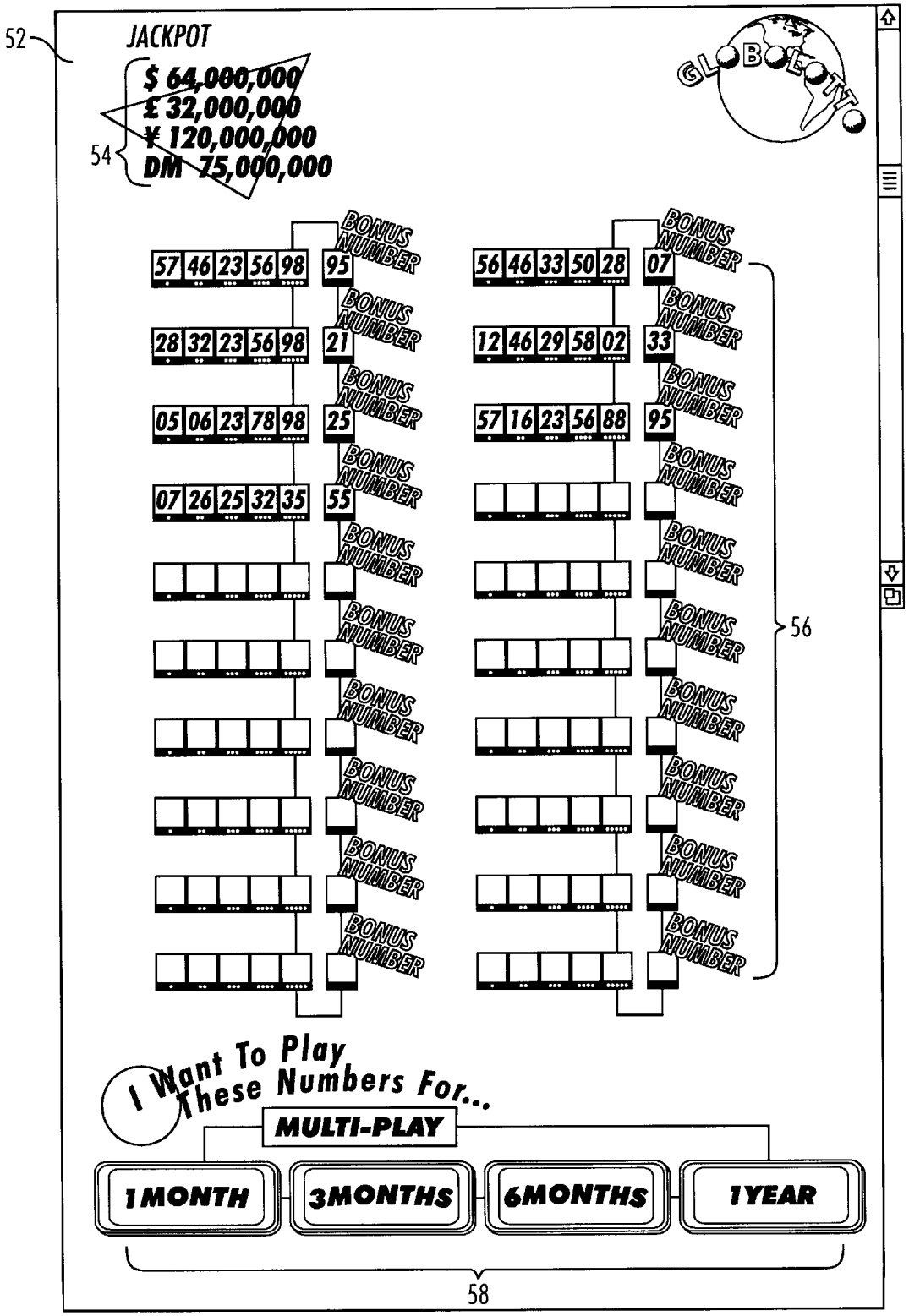
FIG. 5 depicts a preferred embodiment of a game page of the preferred embodiment diagrammed in FIG. 2.

When the user is satisfied with his selections, the user selects a confirmation 27, or multiplay element on the gaming page via an access button 58 (FIG. 5). The gaming server then accesses the confirmation page. Once the user has accessed the confirmation page, the user's selections and number of plays is displayed for the user. The display of the selections provides confirmation 28 to the user that the appropriate selections have been recorded. In one preferred embodiment, the user reconfirms the selections by pressing an "OK" button, or has the opportunity to change the selections by pressing a "No" button, which indicates that the choices are incorrect and allows the user to change the selections.

After the user's selections and plays have been confirmed, the user can access another play via a repeat play member, such as a "Play Another Game" button. If the user pushes the "Play Another Game" button and chooses to play, the server will return the user to the gaming page 30 (FIG. 2). If instead, the user chooses to terminate play, the user then exits the gaming web site 32.

After all of the participants have entered their chosen numbers and/or the allotted time for entry has expired for a particular game, the game administrator or provider presents the winning numbers which are obtained from a predetermined and objective measurement. For example, and discussed below, in one preferred embodiment, the winning indicia are determined from or calculated from portions of the closing stock market prices of predetermined markets. The results of the game are posted and the winners are notified by any acceptable means, including, but not limited, to e-mail, postal service, information presented at registration and posting on the web.

Figure 3A:
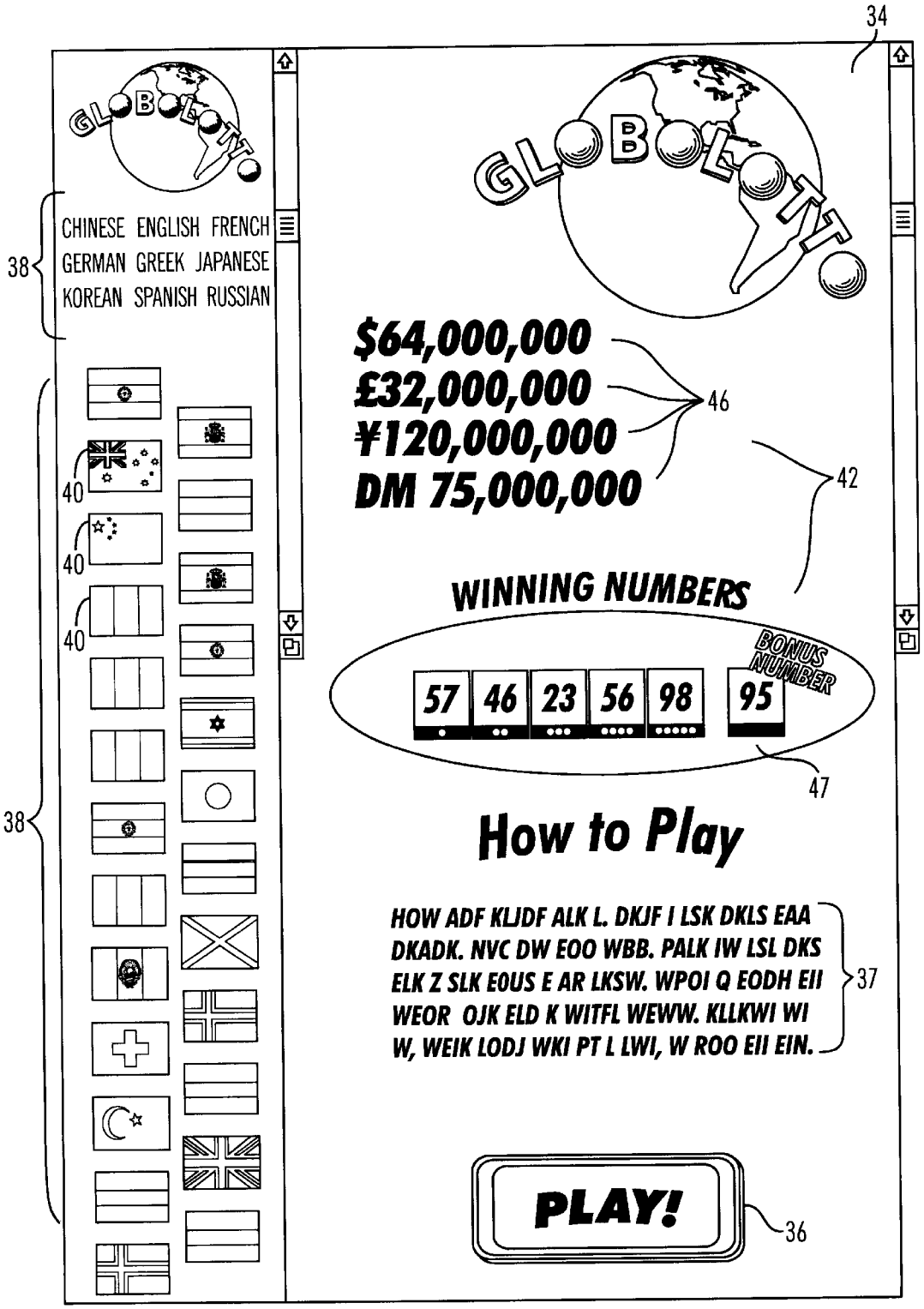
FIG. 3*a* depicts a preferred embodiment of a home page of the preferred embodiment diagrammed in FIG. 2.

As indicated above, some preferred embodiments utilize a wide area network, such as, the Internet, for transmission and receipt of information for the gaming data. In these preferred embodiments the gaming server transmits information to the player in the form of a web site. With reference to FIG. 3*a*, an initial or home page 34 is accessed by the user upon entry into the lottery system. The home page 34 is an introductory page that comprises textual information 37 and hyperlinks 38. In some preferred embodiments, the home page is designed to direct a player to a foreign home page for a specific language 40 wherein the foreign home page displays information and relevant data in the language selected by the player.

The textual information 37 can comprise any type of information that the gaming server 12 chooses. In one preferred embodiment, the textual information 37 comprises gaming information 42, and rules and regulatory information 44, which in some embodiments, as shown, is a link 45 that allows the user to access the rules and regulatory information page (see FIG. 3*b*). Gaming information 42 comprises jackpot totals 46 and previous winning combinations 47.

In one preferred embodiment, the jackpot total is displayed in all of the different currencies of all of the different countries in which the game is played. As more players participate in placing selections, the jackpot becomes larger. As the jackpot becomes larger, the displayed totals change to reflect the updated information in a preset time interval, such as, for example, every minute or every hour.

In addition to displaying the current jackpot totals, in one preferred embodiment, the home page 34 (FIG. 3*a*) displays the winning combinations 47 and/or characters for one or more previous games. In some preferred embodiments, winning numbers and/or characters are updated immediately after the new winning combinations are determined.

Figure 3B:
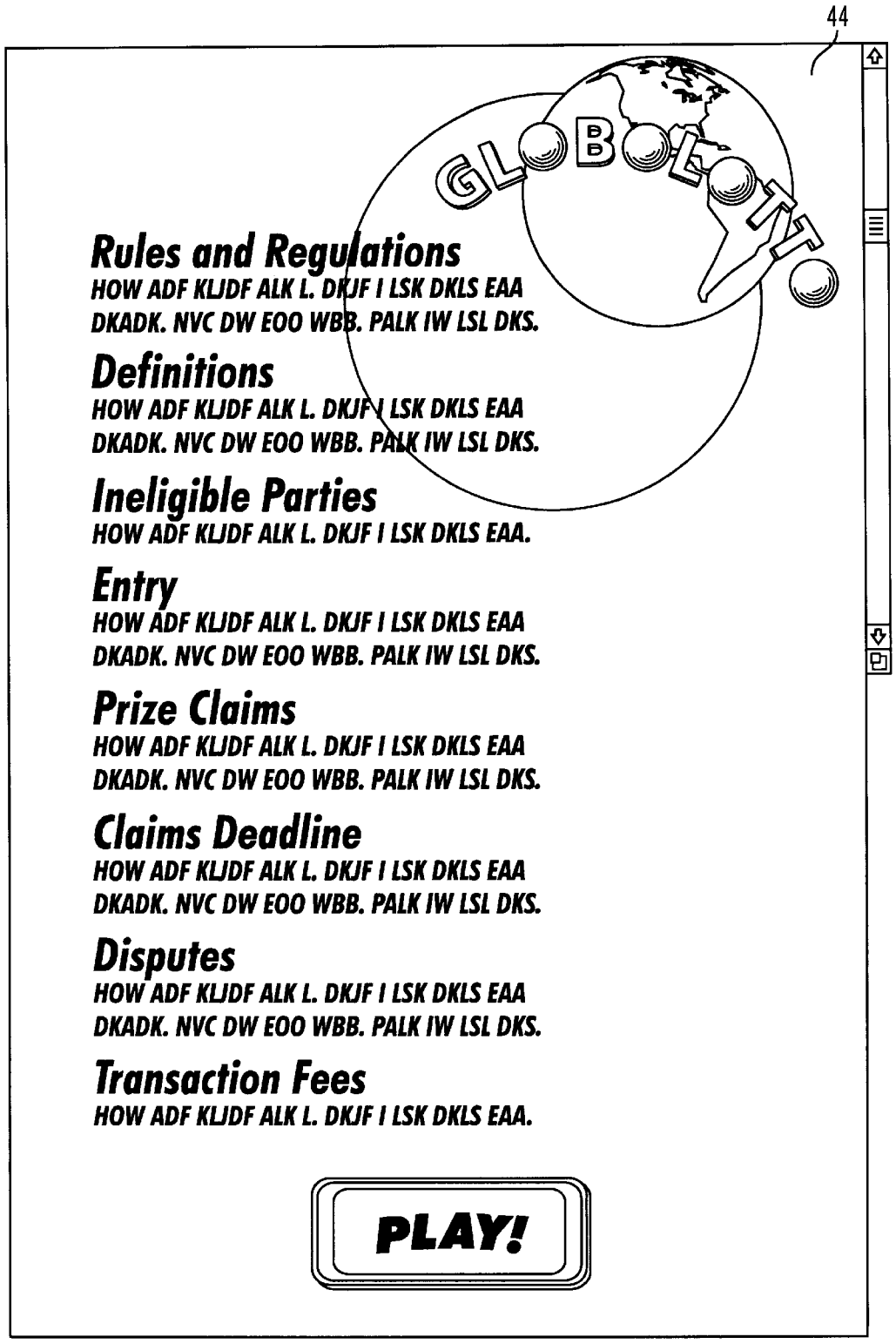
FIG. 3*b* depicts a preferred embodiment of a rules and regulatory information page accessed via the start page, and other pages.

With reference to FIG. 3*b*, the rules and other regulatory information 44 can be included directly on the home page, or, in some preferred embodiments, is accessed via a hyperlink from the home page. In some preferred embodiments, player may also access the rules and regulations from other pages (described below) on the site, or from a number of different pages. If the rules and regulation information 44 is accessed via a hyperlink 45, the user is directed to a file comprising "How to Play" information, wherein information to play the game, such as, the rules and regulations, is retrievably stored. With reference to FIG. 3*b*, preferably, the Rules and Regulations information comprise information related to the restrictions of the game, including, but not limited to, information regarding who is eligible to play the game; how to claim the jackpot; claims deadlines; disputes resolution; miscellaneous transaction fees; entry provisions; and definition of legal terms. As regulations and rules change, due, for example, to changes in laws or the definition of what indicia determines the game results, this section is updated to reflect such changes.

The home page includes at least one hyperlink 36, for example, a "Play" button, such that the player can exit the home page and advance to other pages on the system, wherein the user can ultimately choose selections to play. In one preferred embodiment, the home page comprises hyperlinks 38 to registration or sign-up pages 50 (FIG. 4), which are written in English or a number of foreign languages, or as previously discussed, to the rules and regulations 44 file.

If a user chooses to participate in the game, the user is required to register prior to commencing play of the game. Selection of the aforementioned command hyperlink will send the user to a registration page 50.

Figure 4:
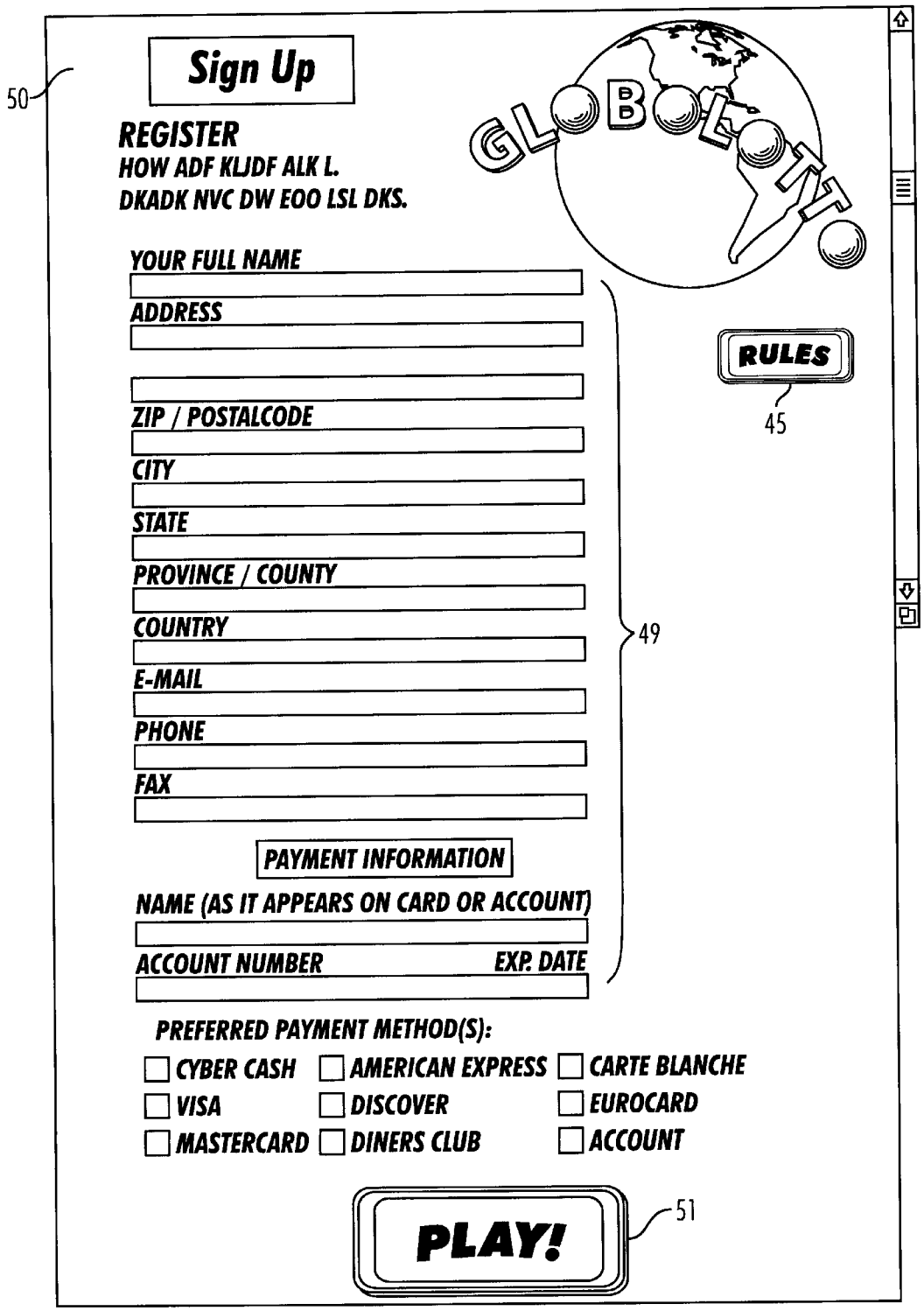
FIG. 4 depicts a preferred embodiment of a registration page of the preferred embodiment diagrammed in FIG. 2.

FIG. 4 depicts one preferred embodiment of a registration or sign-up page 50. The registration page 50 comprises a means for the entering of information 49 required to play the game or optionally sought by the operator of the game. In one preferred embodiment, the means for entering information 49 is a form wherein the user fills in the requested information. In some preferred embodiments, the type of information requested includes, but is not limited to, the player's name, address (which is preferably optional, for reasons of privacy), e-mail address, credit card information, or in-house account information. In preferred embodiments wherein a user is participating from a remote kiosk or ATM-type machine, the user has the option of inserting his credit card information through the use of a credit card reader resident on the kiosk or ATM-type machine (not shown).

Once information has been entered into the registration page 50 (FIG. 4), the player enters a command, such as a HTML hyperlink embedded in a "play" button 51 graphic which moves the user to the next step of the process. In some preferred embodiments, a user cannot progress to the next step of the process until all of the information is provided and the underlying transaction has been authorized and cleared. In some preferred embodiments, if any part of the registration page 50 form is not filled in completely, or if the form of payment is rejected, the player is sent back to the registration page 50 to correct the problem.

In some preferred embodiments, once the requested information on the registration page 50 has been provided and transmitted, and the underlying transaction has been approved and accepted, the user can access the game page 52 (FIG. 5) via the gaming server. In preferred embodiments, the user clicks on a "play" button 51 which accesses the game page 52 if the above requirements have been met.

FIG. 5 illustrates one preferred embodiment of the game page 52. As shown in FIG. 5, in some preferred embodiments, the game page 52 comprises a jackpot display 54, gaming selection slots 56 and a multi-play element 58. The jackpot display 54 displays the current amount of the potential winnings at a given time for the upcoming game. Preferably, the jackpot display 54 will appear in the user's currency. In one preferred embodiment (not shown), a currency converter is provided such that the user can enter their type currency and the converter will display the amount of the jackpot in the user's currency, wherein the conversion is calculated from a chosen currency base, such as, for example, the U.S. dollar or British pound. In these embodiments, the converter indicates the base currency from which the conversion is performed. In another preferred embodiment, currency conversions are automated.

The gaming selection slots 56 are spaces on the game page 52 wherein the user inserts their selection of playing number(s) and/or characters. In some preferred embodiments, the game page 52 further comprises a random generator which accesses the gaming server to randomly generate a selection of playing number(s) and/or characters.

The multi-play element 58 are buttons which allow the user to choose a time frame for which to play the selected numbers or characters. For instance, in some preferred embodiments the player may elect to play the selection of numbers or characters for one drawing (one month), three drawings (three months), six drawings (six months), or twelve drawings (one year). It is to be appreciated that the multi-play element 58 is a convenience for the user and is not available in some preferred embodiments, wherein the user must reenter the selection each time they desire to play. In some preferred embodiments, the multi-play element 58 on the game page 52 automatically connects the player to a confirmation page 60.

Figure 6:
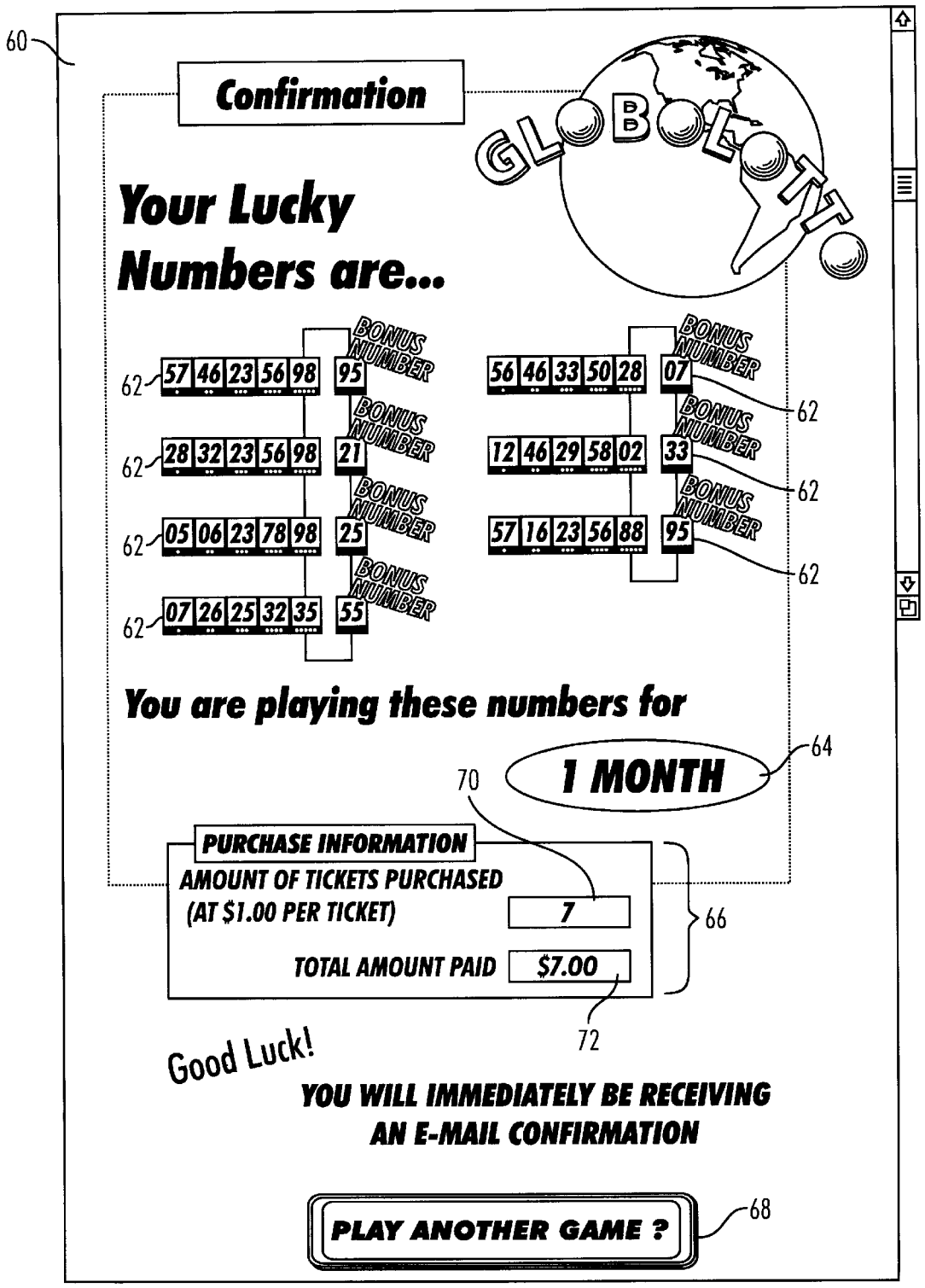
FIG. 6 depicts a preferred embodiment of a confirmation page of the preferred embodiment diagrammed in FIG. 2.

With reference to FIG. 6, a confirmation page 60 comprises a selection display 62, a time play display 64, purchase information 66 and a replay button 68. The selection display 62 is a listing of the user's selection of number(s) and/or characters. In some preferred embodiments, the numbers and/or characters selected by the player can no longer be changed once the player has accessed the confirmation page 60.

The play display 64 displays the time period that the player has selected for the playing of the selected number(s) and/or characters. For instance, the play display 64 indicates "1 Month" or "Six Months". The information contained in the play display 64 is generated from the multi-play element 58. Thus, if no multi-play element 58 is available, the play display 64 need not be included in some embodiments, unless it is desired to indicate the minimum play time.

The purchase information 66 comprises a number of entry displays 70 and the amount of the purchase 72. The number of entry displays 70 displays the number of tickets purchased by the player. The purchase amount 72, which is calculated by the number of tickets purchased by the player multiplied by the cost per ticket and the number of months the numbers are played, displays the total amount charged to the player's credit card or other payment selection, such as, a debit card or cyber cash. In some preferred embodiments, a player can establish an in-house account. In these embodiments, the purchase information further comprises an indicator (not shown) that indicates to the user that the purchase amount 72 has been subtracted from the player's in-house account. It is to be appreciated that the indicator could also indicate additions to the in-house account as well, for instance, if the player adds more money to the account or in the event that the player wins the game, the winnings, or a portion thereof, could be added to the in-house account.

The player is given confirmation of the transaction via a confirmation means. In some preferred embodiments wherein the player is playing the game through a wide area network, such as, the Internet, in which e-mail may be transmitted, the player can be e-mailed a written confirmation with the selection numbers and/or characters and a confirmation code. In other preferred embodiments, the player is given a file corresponding to a universal bar code representation of his transaction which is transmitted to his terminal via a wide area computer network. In another preferred embodiment, wherein the player is accessing the gaming server via a remote kiosk, the kiosk will print out the selection numbers and/or characters, and a confirmation code for the player. In other embodiments, other suitable confirmation means may be employed, including, but not limited to, the mail or postal system, telephone and telegram.

The replay button 68 is a hyperlink or a command embedded in the graphic button that allows the user to reaccess the game. In one preferred embodiment, the replay button 68 is a button that is "PLAY ANOTHER GAME?". In some preferred embodiments, the replay button 68 connects the user with the game page 52 (FIG. 2) and allows the user to play again. In some preferred embodiments, data received from the registration page 50 (FIG. 4) is accessible from the gaming server so that player does not have to provide payment and other registration page 50 (FIG. 4) information again. It is to be understood that in some preferred embodiments, the replay button 68 can access any one of the previously described pages and is not limited to reaccessing the game page 52.

Preferred embodiments utilizing a remote kiosks will not have a replay button 68, or a "PLAY ANOTHER GAME?" button. Although this element can be incorporated into the design, it is preferably not included so as to prevent fraudulent acts which could potentially occur if a player leaves a kiosk without exiting the game. As such, in embodiments having a kiosk, a replay requires a re-inputting of the player's credit information. It is to be understood that this element is not intended to be permanently eliminated from the remote kiosk systems, or to suggest that it could not be included. Indeed, in some preferred embodiments, a timer is included that automatically exits a player from a game within a predefined short period of time. In still other preferred embodiments, the system requests password information which has been previously entered on one of the previously described pages, such as, the registration page 50, which verifies the player identification.

Figure 7:
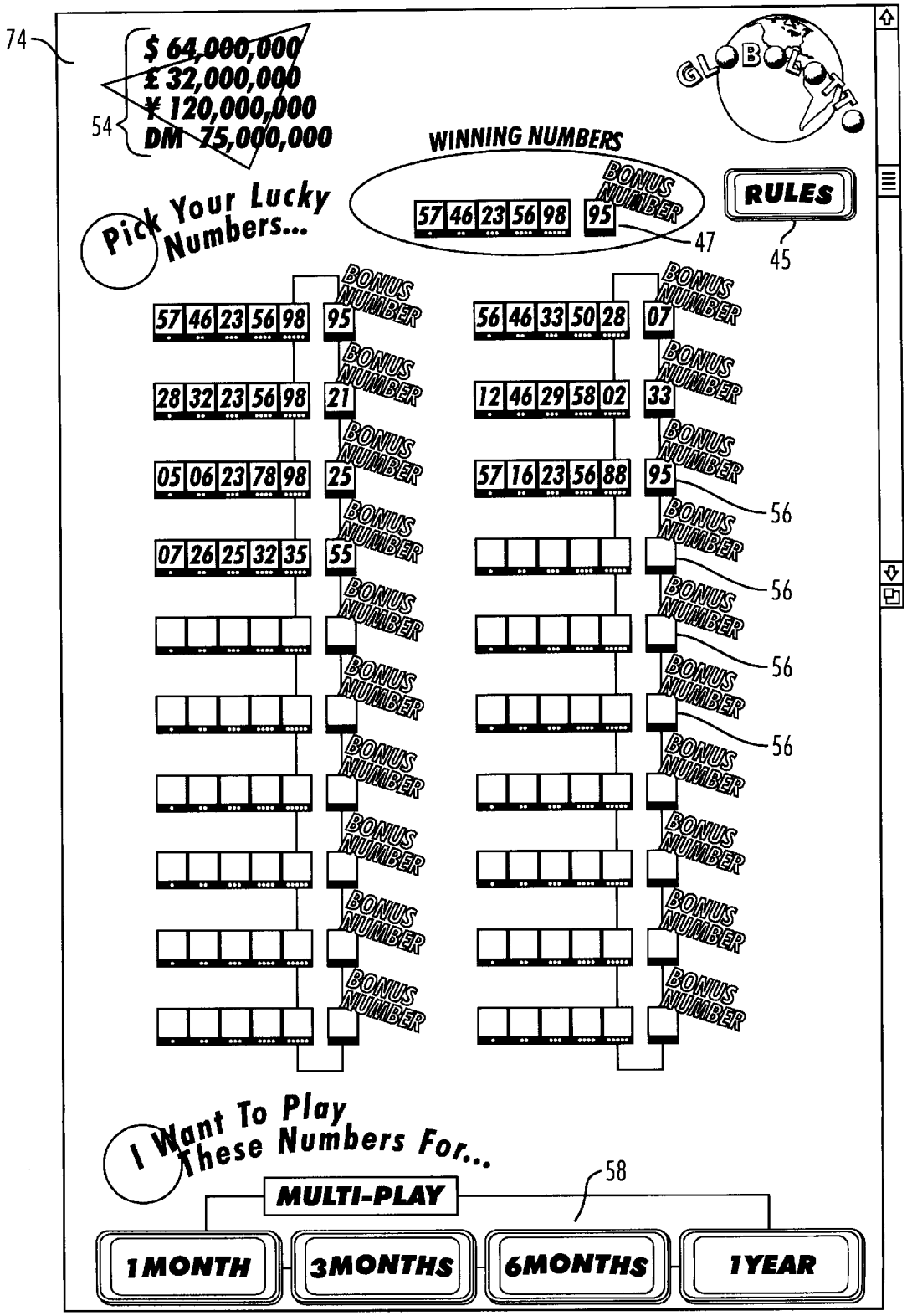
FIG. 7 is a preferred embodiment of a cookie page for automatic payment history.

Although the above describes basic embodiments of the invention, it is not intended to limit the invention. Indeed, variations on the manner in which information is obtained from the user, or displayed to the user is envisioned. For instance, with reference to FIG. 7 in some preferred embodiments, the gaming server provides the user access to a "Cookie Page" or player information page 74. In preferred embodiments, the player information page 74 comprises many of the same features as the gaming page 52 (FIG. 5), such as, current jackpot amounts 54, the winning numbers and/or characters for the previous game 47, a rules hyperlink button 45, a multiplay button 58, gaming selection slots 56 and a random indicia provider or generator button (not shown).

The player information page 74 allows the user to record and automate payments on-line. This information is not visible to the user; however, it is transferred to the server computer 12 when the user enters the game utilizing the player information page 74 or cookie page. Other types of encrypted information includes, but is not limited to, language and currency designations. In this way, for example, a wide area network player, such as, an Internet player, does not have to provide all of the payment information for each game played; thus, allowing the player to save time. In these embodiments, the player information is maintained on the user's computer 14, and is automatically transferred to the gaming server whenever a player (who has designated this option) accesses the server for this purpose.

Once the players have inputted their gaming information, they need only wait for the playing of the game. In preferred embodiments, the selection of numbers or other character sequences which serve as the winning combination for a particular game is provided by an objective and user verifiable source. In preferred embodiments, the selection of numbers and/or characters comprise a combination or recombination of all, or some, component parts of numbers or and/or other characters which have been publicly published for a purpose or purposes unrelated to lottery or lottery-type game or other gaming purposes. The composition of the winning combination of numbers or characters are predetermined prior to the execution of the game and are publicly known to the players.

In preferred embodiments, the winning combination is determined by a indicia providing source. The source provides, or generates, a publicly available combination of indicia after, but not before, a particular time, date, or other predetermined event, and provides or generates such indica for purposes independent of gaming. In one preferred embodiment, the time, date or other predetermined event is the time by which all registrations for play by all participants have been placed.

The indicia providing source is any source that is verifiable by all users and is not substantially related to the game or game provider. In some preferred embodiments, the indicia providing source adheres to the principles set forth in the Random Walk Hypothesis which asserts that for trading instruments, the price fluctuation and movement of the instruments occurs randomly in the short term. Accordingly, there is no correlation between the return in one period and the return in the next period, such that a chance of any particular return cannot be predicted. It is to be understood that the hypothesis is meant to illustrate the nature of the trading instruments.

In some preferred embodiments, the indicia providing source is a collection of one or more representations of the global markets, including, but not limited to, the indices of the New York Stock Exchange, the Frankfurt DAX, the Paris CAC 40, the London FTSE, the Tokyo Nikkei 225 and the Hong Kong Hang Seng. It is to be appreciated that some or all of these markets can be included as a part of the indicia providing source. Further, it is to be appreciated that the composition of the indicia providing source can change from game to game such that different markets are included in the composition of the indicia providing source.

In addition to choosing the composition of the indicia providing source, a specific time is chosen as to when the market values, or portions of the numbers representing the market values (discussed below) generate the winning combinations. Any point in time can be chosen, including, by not limited to, the opening number on a given day, the closing number on a given day, an intra-day number, an "after market" trading number, a bid (the price at which the investor will sell the trading instrument), and an ask (the prices at which the investor buys the trading instrument). An intra-day number is a number generated by the market within a given trading period, such as for example, a particular trading day's high or low market price.

With respect to the composition of the winning combination, the composition of the winning combination can be defined as any set of elements, such as, digits or characters, which can be composed of a variety of components from different aspects of the indicia providing source. For instance, in some preferred embodiments, a winning selection of numbers comprise an agreed-upon number of a fixed number of digits, wherein each element in the set of digits or characters can be individually defined. For example, in one preferred embodiment, the winning number is a twelve-digit number, wherein the value of each component digit in the winning number is derived from predefined publicly published number(s) and/or character(s).

In one preferred embodiment, the combination is determined from any portion or form of the configuration of, for example, the various stock markets, bond markets, options markets, future markets and commodity markets. The specific number for each element of the winning combination can be determined by an index, a stock (equity), a bond, a stock option, a commodity, a commodity option, a future, a futures option, a currency, a currency option, a government bond number, an interest rate, or any other form of trading instrument openly traded on an exchange anywhere in the world.

With reference to FIG. 8, in one preferred embodiment, the winning number is a twelve digit number comprised of a sequence of six two-number sequences, wherein each two-number sequence is ascertained from the closing figures of a particular stock market. For example, in one preferred embodiment, the first two-number sequence comprises the last two numbers to the left of the decimal of the reported closing figure for the Frankfurt DAX on a specified future date; the second two-number sequence comprises the last two numbers to the left of the decimal of the reported closing figure for the Paris CAC 40 on the specified future date; the third two-number sequence comprises the last two numbers to the left of the decimal of the reported closing figure for the London FTSE on the specified future date; the fourth two-number sequence comprises the last two numbers to the left of the decimal of the reported closing figure for the New York NYSE on the specified future date; the fifth two-number sequence comprises the last two numbers to the left of the decimal of the reported closing figure for the Tokyo Nikkei 225 on the specified future date, and the sixth two-number sequence comprises the last two numbers left of the decimal of the reported closing figure for the Hong Kong Hang Seng on the specified future date. Thus, as shown in FIG. 8, the winning combination would be 98, 67, 40, 09, 79 and 65. Each of the stock exchange closing figures are the result of the cumulative purchases of millions of investors in those markets around the world on the close of a date certain. Consequently, the resulting averages resulting in the closing numbers cannot be falsified or "rigged." As such, the process of selecting winning numbers is not controlled by the operators of the lottery and is therefore, objective and verifiable. Further, the winning number and each of its component parts are immediately verifiable by all of the participating players around the world by simply consulting the financial pages of their newspapers, or accessing the closing averages via electronic means over a remote access source, such as, the Internet, from independent news services.

In other preferred embodiments, the winning number and/or character sequence may be selected by any recombination of the order of the aforementioned stock exchanges to produce the sequence of winning two-digit numbers. For example, the first through sixth two-digit number pairs may be derived from the last two digits of the reported closing figure for each of the aforementioned exchanges in the following order: Paris CAC 40, London FTSE, New York NYSE, Tokyo Nikkei 225, Hong Kong Hang Seng and Frankfurt DAX. In still another preferred embodiment, the combination of winning numbers can be derived from any combination of the above exchanges wherein no particular order of the exchanges is required.

In other preferred embodiments, numbers and/or characters comprising the winning number and/or character sequence can be derived from a combination, recombination or permutation of one or more components of one or more of the closing figures of the aforesaid exchanges on the specified future date. For example, in some preferred embodiments, the first two-digit number comprising the twelve digit winning number is derived from the last and first digit of one of the exchanges, while the second two-digit number is derived from the third and last digits of another exchange.

In still another preferred embodiment, the winning combination can be determined over a series of days or another set time, wherein each element of the winning combination is predefined by a particular source, for example, a stock market or bond market, and is to be determined at a particular time. For instance, in a two-digit twelve number winning combination, the first two digits could be determined by the last two digits to the left of the decimal of the New York Stock Exchange on a first day of the month; the second two digits is determined by the last two digits to the left of the decimal of the Tokyo Exchange on the fifth day of the month. The remaining set of digits would be defined in the same manner. As such, any combination of sources and times to determine the digits is suitable. It is to be understood that one source for all of the digits could be used, for example, the New York Stock Exchange, wherein each two-digit set is determined by the Exchange on a predefined day.

In some preferred embodiments other published and independently verifiable closing figures for a specific day or series of days may be used. For example, numbers and/or figures used to derive the winning number may be drawn from closing figures of other stock exchanges, commodity exchanges, individual stock and/or commodity closing prices, future indexes, fund indexes, and/or combination(s), recombination(s), and/or permutation(s) thereof. In other preferred embodiments, numbers and/or characters are also derived from one or more published lottery results, score results of sporting events, weather statistics, police statistics, birth statistics, death statistics, and/or combination(s), recombination(s) and/or permutation(s) thereof. As shown, any combination of numbers and/or characters can be predefined to comprise the winning combination and is not dependent upon anything that is controlled by the game provider.

It is to be appreciated that any combination of times, sources and definitions of the elements comprising the winning combination is suitable. For instance, multiple trading instruments could be used at the same time, or different times. For example, the winning combination is the spot price of gold and platinum on the closing price of three consecutive days, wherein the winning digits are derived from the two digits left of the decimal. The above embodiments are not intended to limit the invention, but rather, encompass any permutations of the above described elements, including, but not limited to, combinations of the time frames, the sources used, and the definition of the elements comprising the winning combination. For instance, instead of six markets, three markets could be used or a reduced odds game could be played wherein the user is required to choose less than all of the winning elements to be determined a winner.

In another preferred embodiment, a user is allowed to select at least one additional number, wherein the user is allowed to substitute the additional number for one of the primary choices. For example, a user chooses 21, 45, 65, 22, 89 and 11 as primary choices, and selects 12 as an additional choice. If the winning combination is 21, 45, 65, 12, 89 and 11, the user is allowed to substitute 12 for 22, and thus, has a winning combination. If instead, the winning combination were 12, 11, 34, 45, 56, 67 and the player chose 12, 11, 45, 34, 01, 02, and the bonus number 56, the player will still win. The player will have picked 12, 11, 45, 34 correctly and could substitute 56 for the wrong choice of either 01 or 02. In this instance, the user has chosen five of the six numbers and might still win depending upon the game.

To play the game, in some preferred embodiments, a player selects six (6) pairs of numbers ranging from 00 to 99. For example, a player has chosen the following six pairs of numbers: 98-67-40-09-79-65. On the day predetermined to be the day that the winning numbers are to "selected", the numbers corresponding with the first two (2) numbers just left of the decimal point of the closing numbers of the six (6) major world market stock exchanges are ascertained and compiled into a sequence to produce the "winning" twelve digit number. The following table sets forth an example of the closing stock markets for the selected markets:

| | |
|---|---|
| Frankfurt DAX | 3798.51 |
| Paris CAC 40 | 2867.34 |
| London FTSE | 4640.97 |
| New York NYSE | 7709.35 |
| Tokyo Nikkei 225 | 14,679.64 |
| Hong Kong Hang Seng | 8,065.02 |

The underlined digits in each closing price indicates the numbers which comprise the winning combination. Thus, in this example, the winning combination is 98-67-40-09-79-65, and the player would have won. In preferred embodiments, the winning numbers are independently verified by the user or for example, by the operator of the lottery and, for example, an accounting firm. Once a user has won, user or users who have won receive an instant pay-off of all winnings via wire transfer from a major money market international bank.

In other preferred embodiments, other modes of selecting the winning indicia are illustrated in the following examples.

1. Non-Market Specific Embodiment

In another preferred embodiment, a non-market specific basis allows the same stock market indexes used in the above described embodiment to be used to generate the winning numbers, but which specific market generated which number is not important. An example of this is:

| | |
|---|---|
| Frankfurt DAX | 3798.51 |
| Paris CAC 40 | 2867.34 |
| London FTSE | 4640.97 |
| New York NYSE | 7709.35 |
| Tokyo Nikkei 225 | 14,679.64 |
| Hong Kong Hang Seng | 8,065.02 |

In this instance, the player is not required to choose the specific market to generate a specific winning number (98, 67, 40, 09, 79, and 64) as the numbers can be generated by any of the stock market indexes. Similar to the previously described embodiments, in this embodiment, other trading instrument (for example, other than the major stock market indexes described) can be used to generate the winning numbers. Thus, for example, other indicia providing sources, include, but are not limited to, all other indexes not previously mentioned, stocks (equity), bonds, stock options, commodities, commodity options, futures, futures options, currencies, currency options, Government Bond number or interest rates (for any government in the world), or any other form of trading instrument which is openly traded on any exchange any where in the world.

2. A Specific Trading Instrument on a Multiple of Trading Time Periods

In this preferred embodiment, a single trading instrument, such as a stock market index, is used as a indicia providing source. However, each indicia in the winning combination, that is, the component numbers, are generated at different times.

For example, the New York NYSE Dow Industrial Average index trades at: $7675.00 on the first day; $7783.98 on the second day; $7702.89 on the third day; $7685.94 on the forth day; $7895.45 on the fifth day; and $7925.23 on the sixth day. Assuming that the two-digits defined as the elements in the winning combination are the two digits left of the decimal, the winning numbers for this example would be 75, 83, 02, 85, 95, 25, wherein the winning numbers are generated by one trading instrument on the close of each consecutive day. This would generate a multitude of numbers from one trading instrument. In other preferred embodiments, the numbers could be generated at any time, including, but not limited to, the opening number, the closing number, an intra-day number (meaning a number generated inside any given trading day period), an after market number, the Bid (for "a" through "d" above) and the Ask (for "a" through "d" above).

In other preferred embodiments, a variety of trading times for one trading day could be used. For instance, the winning numbers could be picked by selecting the numbers for the open, the close, the inter-day high, and inter-day low for the same trading instrument for that one trading day. This would generate four specific numbers from one trading instrument on one given trading day.

3. Multiple Trading Time Period/Multiple Trading Instrument

In still another preferred embodiment, the number of trading instruments are combined with a number of different trade times. For instance, the trading instrument could be the price for the spot gold and spot platinum close on the close of three consecutive days. One example is as follows:

Day 1 the gold spot market is $385.00 per ounce;
Day 1 the platinum spot market is 422.89 per ounce;
Day 2 the gold spot market is $372.89 per ounce;
Day 2 the platinum spot market is 421.39 per ounce;
Day 3 the gold spot market is $392.90 per ounce; and
Day 3 the platinum spot market is 412.39 per ounce.

If the two number left of the decimal point are designated as the components of the winning numbers, the following numbers will be generated:

85,22,72,21,92,12.

Similar to the previously described embodiments, in this embodiment, other trading instrument (for example, other than the major stock market indexes described) can be used to generate the winning numbers. Thus, for example, other indicia providing sources, include, but are not limited to, all other indexes not previously mentioned, stocks (equity), bonds, stock options, commodities, commodity options, futures, futures options, currencies, currency options, Government Bond number or interest rates (for any government in the world), or any other form of trading instrument which is openly traded on any exchange any where in the world.

In still another preferred embodiment, any time frame for selection of the numbers can be utilized, including, but not limited to, the opening number, the closing number, an intra-day number (meaning a number generated inside any given trading day period), an after market number, the Bid (for "a" through "d" above), and the Ask (for "a" through "d" above).

It is to be appreciated that although the above described embodiments utilize six selected numbers as the winning combination, more or less numbers to generate a winning combination can be used.

4. Reduced Odds

In yet a further preferred embodiment, the game can be structured such that there is reduced odds, which creates lower odds and lower pay out games. For instance, in one preferred embodiment, a reduction in the number of trading instruments is incorporated into any of the previously described embodiments. For example, only five market indexes are used, as opposed to six. In this embodiment, a user need only be correct in four of the five two-digit combinations provided by the markets. As the number of markets have been reduced, the game results in lower odds.

In another preferred embodiment, the number of indicia providing sources are reduced, but the user must correctly choose all of the provided indicia correctly as the user is not provided any extra choices. For instance, in the following example, Frankfurt DAX 3798.51
Paris CAC 40 2867.34
London FTSE 4640.97 the user is required to choose 98, 67 and 40 to win. It is to be appreciated that this type of variation is compatible with non-market specific embodiments.

Although the above embodiments describe the invention in preferred embodiments utilizing a wide area network or a remote kiosk, it is to be understood that other embodiments of this invention can be implemented that utilize other modes of communication or payment. For instance, in some preferred embodiments, players access the gaming server and play the game via standard telephone interface means. In some preferred embodiments using a standard telephone interface means, a player calls a predetermined telephone number, and once on-line with a gaming server or attendant, the player enters credit card information, and then selects their desired numbers. In some preferred embodiments, the confirmation for this transaction would be printed on the player's telephone bill, along with the numbers and the player's confirmation code. In some preferred embodiments, the player is automatically billed for his tickets on his telephone bill.

In another preferred embodiment of the invention a telephone/facsimile interface means is employed. In some of such preferred embodiments, a player calls a telephone number and enters his credit card number, selected numbers and facsimile number. The transaction is then billed to the player's credit card and the player is automatically faxed the confirmation of the selected numbers along with the player's confirmation code.

Although the preferred embodiments have been described with a particular number of game pages and information inputs on these pages, it is to be understood that embodiments of the instant invention can be configured to include any number of game pages including any desired information. Indeed, the pages and information requested and/or contained on each page can be changed with each iteration of the game if so desired. Indeed, embodiments of the invention can exclude any of the above described pages or informational inputs or include any other type of page or information input.

Further, embodiments of the instant invention are not intended to limit the manner in which the winning combination is predefined. Indeed, the gaming provider can establish definitions for the winning combination, and redefine the composition of the winning combination without affecting the essence of embodiments of the invention. Indeed, the disclosure it is intended to include other preferred embodiments encompassing other definitions or compositions of the winning combination. As such, the foregoing is intended to cover all modifications and alternative constructions falling within the spirit and scope of the invention.

What is claimed is:

1. A system for providing a game on a computer network having a game provider computer and a game player recipient processor, the system comprising:

means for operating the provider computer to receive registration information from the recipient computer, the registration information including user-selected game entry indicia;

means for operating the provider computer to receive a winning combination of a plurality of indicia, said winning combination of indicia comprising indicia generated for purposes independent of said game providing system, by at least one publicly available source, wherein each indicia comprises a predefined portion of a publicly available source such that the winning combination comprises a combination of the predefined portions of the at least one publicly available source, wherein the winning combination is different than the publicly available source;

means for operating the provider computer to compare user-selectable entry indicia with the winning combination of indicia to determine a degree of match;

means for operating the provider computer to provide information regarding the degree of match determined by the means for comparing.

2. A system as recited in claim 1, further comprising means for operating the provider computer to provide data representing a registration form to the recipient processor for allowing a user to enter user-selected game entry indicia.

3. A system as recited in claim 1, wherein said means to receive a winning combination of indicia comprising means for receiving a combination of indicia which becomes publicly available from said source no earlier than after the receipt of registration information by the provider computer.

4. A system as recited in claim 1, wherein said indicia generated by a publicly available source comprises a portion of at least one of a price of preselected securities, prices of a combination of preselected securities, and an average of prices of preselected securities.

5. A system as recited in claim 1, wherein said means to receive registration information comprises means for receiving registration information over a wide area network.

6. A system as recited in claim 5, wherein said wide area network comprises the Internet.

7. A system as recited in claim 1, wherein said means to provide information regarding the degree of match comprises means for identifying any recipient processor that provided user-selectable entry indicia that substantially matches the winning combination of indicia.

8. A system as recited in claim 1, wherein the recipient processor comprises a facsimile machine.

9. A system as recited in claim 1, wherein the recipient processor comprises a telephone.

10. A system as recited in claim 1, wherein said indicia generated by a publicly available source consist of a portion of any market numbers of the following group: a primary stock market index, a bond market index, an options market index, a future market index and a commodity market index.

11. A system as claimed in claim 10, wherein the publicly available indicia consist of a portion of any of market numbers of the following group: the opening number on a predefined day; the closing number on a predefined day; an intra-day number; an after market number; a bid; and an ask.

12. A system as claimed in claim 11, wherein the portion of the mark numbers, wherein each market number is extended to the hundreth decimal place, consist of any of the following group: two digits let of the decimal place; two digits right of the decimal place; and the two first digits of the market number.

13. A system for providing a game on a computer network as claimed in claim 1, wherein the at least one publicly available source comprises a plurality of different publicly available sources and wherein said combination of predefined portions of at least one publicly available source comprises a combination of predefined portions of the plurality of different publicly available sources.

14. A method for providing a game on a computer network having a game provider computer and a game player recipient processor, the method comprising:

receiving registration information on the provider computer from the recipient computer, the registration information including user-selected game entry indicia;

receiving a winning combination of indicia on the provider computer, said winning combination of indicia comprising indicia generated for purposes independent of said game providing system, by at least one publicly available source, wherein each indicia comprises a predefined portion of the publicly available source such that the winning combination comprises a combination of the redefined portions of the at least one publicly available source, wherein the winning combination is different than the publicly available source;

comparing, on the provider computer, user-selectable entry indicia with the winning combination of indicia to determine a degree of match;

providing, from the provider computer, information regarding the degree of match determined by the means for comparing.

15. A method as recited in claim 14, further comprising the step of providing data representing a registration form from the provider computer to the recipient processor for allowing a user to enter user-selected game entry indicia.

16. A method as recited in claim 14, wherein said step of receiving a winning combination of indicia comprising receiving a combination of indicia which becomes publicly available from said source no earlier than after the receipt of registration information by the provider computer.

17. A system as recited in claim 14, wherein said indicia generated by a publicly available source consist of a portion of any market numbers of the following group: a price of a preselected securities, prices of a combination of preselected securities, and an average of prices of preselected securities.

18. A method as recited in claim 14, wherein said step of receiving registration information comprises receiving registration information over a wide area network.

19. A method as recited in claim 18, wherein said wide area network comprises the Internet.

20. A method as recited in claim 14, wherein said step of providing information regarding the degree of match comprises identifying any recipient processor that provided user-selectable entry indicia that substantially matches the winning combination of indicia.

21. A system for providing a game on a computer network as claimed in claim 14, wherein the at least one publicly available source comprises a plurality of different publicly available sources and wherein said combination of predefined portions of at least one publicly available source comprises a combination of predefined portions of the plurality of different publicly available sources.

* * * * *